US007810912B2

(12) United States Patent
Ozawa

(10) Patent No.: US 7,810,912 B2
(45) Date of Patent: Oct. 12, 2010

(54) DROPLET DISCHARGING HEAD AND DROPLET DISCHARGING DEVICE

(75) Inventor: Kinya Ozawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 879 days.

(21) Appl. No.: 11/677,864

(22) Filed: Feb. 22, 2007

(65) Prior Publication Data

US 2007/0211120 A1 Sep. 13, 2007

(30) Foreign Application Priority Data

Mar. 9, 2006 (JP) ..... 2006-064777

(51) Int. Cl.
*B41J 2/05* (2006.01)

(52) U.S. Cl. ..... 347/65

(58) Field of Classification Search ..... 347/56–59, 347/61–65, 67, 50, 40, 44, 45, 47, 49, 20; 29/890.1

See application file for complete search history.

(56) References Cited

U.S. PATENT DOCUMENTS 6,045,214 A * 4/2000 Murthy et al. ..... 347/47
6,652,079 B2 * 11/2003 Tsuchii et al. ..... 347/65

FOREIGN PATENT DOCUMENTS

JP A-06-091869 4/1994
JP A 06-316081 11/1994
JP A-11-070650 3/1999
JP A 2002-283585 10/2002
JP A 2002-361892 12/2002
JP A 2003-094684 4/2003
JP A 2003-211644 7/2003
JP A 2004-276433 10/2004
JP A-2005-178125 7/2005
JP A 2005-313428 11/2005

* cited by examiner

*Primary Examiner*—K. Feggins
(74) *Attorney, Agent, or Firm*—Workman Nydegger

(57) ABSTRACT

A droplet discharging head includes: a nozzle portion that discharges a liquid material; a liquid chamber that is in communication with the nozzle portion and supplies the liquid material to the nozzle portion in receiving a pressure from outside; and a reservoir that is in communication with a plurality of the liquid chamber through a plurality of ink supply passages and supplies the liquid material fed from outside via a material inlet to the plurality of liquid chambers. In the droplet discharging head, assuming that: a direction running from the material inlet toward the liquid chamber is a first direction; a direction perpendicular to the first direction is a second direction; a straight line passing through the material inlet in the first direction is a first reference line; and a straight line passing through the material inlet in the second direction is a second reference line, the longer a distance from the second reference line is for a liquid chamber, the shorter a distance from the first reference line is for the liquid chamber.

10 Claims, 7 Drawing Sheets

DROPLET DISCHARGING HEAD AND DROPLET DISCHARGING DEVICE

BACKGROUND

1. Field of the Invention

Several aspects of the present invention relate to a droplet discharging head and a droplet discharging device.

2. Related Art

It is required that droplet discharging heads employed in droplet discharging devices including inkjet recorders discharges more minute droplets.

In order to have an discharged droplet more minute, it is necessary to reduce the period of vibration in the cavity that supplies a liquid material to the nozzle in receiving pressures from outside through oscillation. In order, in turn, to reduce the period of vibration in the cavity, it is required that the entire flow path of a liquid material be made smaller. Such flow path includes the nozzle, the cavity and the reservoir that stores a liquid material to be supplied to the cavity.

However, if the reservoir is made smaller, resistance increases in the reservoir against the flow of the liquid material, thereby reducing the efficiency in supply of the liquid material to the cavity. This may cause some nozzles to eject droplets without sufficient supply of the material.

JP-A-2003-211644 is an example of related art, disclosing a technology that concerns supply of ink in inkjet recorders.

SUMMARY

An advantage of the invention is to reduce variation in supply of a material to each nozzle in a droplet discharging head.

A droplet discharging head according to a first aspect of the invention includes: a nozzle portion that discharges a liquid material; a liquid chamber that is in communication with the nozzle portion and supplies the liquid material to the nozzle portion in receiving pressures from outside; and a reservoir that is in communication with a plurality of the liquid chamber through a plurality of ink supply passages and supplies the liquid material, having been supplied from outside via a material inlet, to the plurality of liquid chambers. In the droplet discharging head, assuming that: a direction running from the material inlet toward the liquid chamber is a first direction; a direction running perpendicular to the first direction is a second direction; a straight line passing through the material inlet in the first direction is a first reference line; and a straight line passing through the material inlet in the second direction is a second reference line, the longer the distance from the second reference line is for a liquid chamber, the shorter the distance from the first reference line is for the liquid chamber.

A droplet discharging head according to a second aspect of the invention includes: a reservoir having a material inlet; a plurality of ink supply passages connected to the reservoir; a plurality of liquid chambers connected respectively to each of the plurality of ink supply passages; and a plurality of nozzle portions connected respectively to each of the plurality of liquid chambers. In the droplet discharging head, a normal line made from the outer circumference of the reservoir to the connection between a first of the plurality of liquid chambers and a first of the plurality of ink supply passages is shorter in length than the first ink supply passage.

A droplet discharging head according to a third aspect of the invention includes: a reservoir having a material inlet; a plurality of ink supply passages connected to the reservoir; a plurality of liquid chambers connected respectively to each of the plurality of ink supply passages; and a plurality of nozzle portions connected respectively to each of the plurality of liquid chambers. In the droplet discharging head, a normal line made from the outer circumference of the reservoir to the connection between a first of the plurality of liquid chambers and a first of the plurality of ink supply passages is different in length from a normal line made from the outer circumference of the reservoir to the connection between a second of the plurality of liquid chambers and a second of the plurality of ink supply passages.

This alleviates the difference in time for the liquid material to reach each of the liquid chambers and realizes a nearly uniform efficiency in supply of the liquid material to each liquid chamber. Consequently variation in supply of the material to each nozzle can be reduced.

In the above droplet discharging head, it is preferable that the normal line made from the outer circumference of the reservoir to the connection between the first of the plurality of liquid chambers and the first of the plurality of ink supply passages be shorter in length than the first ink supply passage.

In the above droplet discharging head, it is preferable that the plurality of ink supply passages are each different in length.

In the above droplet discharging head, it is preferable that: the reservoir have a plurality of connections connecting to the plurality of supply passages; the reservoir have a side surface that is at least partly a curved face; and the plurality of connections be formed on the curved face.

In the above droplet discharging head, it is preferable that: the reservoir have a plurality of connections connecting to the plurality of supply passages; the reservoir have a polygonal bottom face; the side surface of the reservoir be composed of a plurality of faces; and a first of the plurality of connections be formed on one of the plurality of faces while a second of the plurality of connection be formed on another of the plurality of faces.

It is preferable that the above droplet discharging head include a plurality of the reservoir.

In the above droplet discharging head, it is preferable that the plurality of reservoirs be disposed to form a zigzag shape. This allows a highly dense disposition of the reservoirs and the nozzles.

A droplet discharging device according to a fourth aspect of the invention includes the above droplet discharging head.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described.

In the embodiments of the present invention, "interval" refers to "length" and is used in a wider sense than "distance" that is used to represent the length of a line segment connecting two points as orthographically projected on a plumb line.

First Embodiment

Figure 1A:
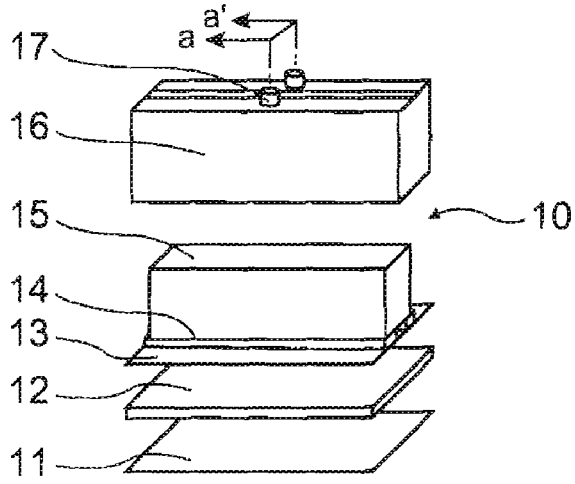
FIG. 1A is a schematic diagram that shows a droplet discharging head according to one embodiment of the invention in a disassembled state thereof.
Figure 1B:
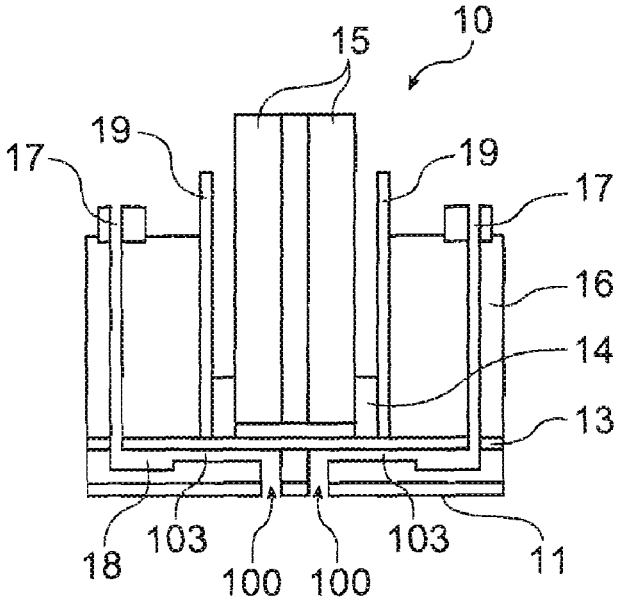
FIG. 1B is a diagram that shows a sectional view of FIG. 1A as sectioned in the direction of a-a'.

As shown in FIGS. 1A and 1B, a droplet discharging head 10 according to a first embodiment of the invention includes a nozzle plate 11, a flow path substrate 12, a diaphragm 13, piezoelectric elements 14, support substrates 15, a head case 16 and electrodes 19. Nozzle portions 100 are formed in the nozzle plate 11 and reservoirs 18, cavities (liquid chambers) 103 and ink supply passages 102 communicating the reservoirs 18 and the cavities are formed between the flow path substrate 12 and the diaphragm 13.

The structure of the droplet discharging head is not limited to one described above but may also be one in which the nozzle plate 11 and the flow path substrate 12 are integrally formed if the structure allows application of the relationship between the reservoirs 18, the cavities 103 and the ink supply passages 102 to be described below. Also, the nozzle portions 100 may be provided on the borderline between the flow path substrate 12 and the diaphragm 13.

Figure 2:
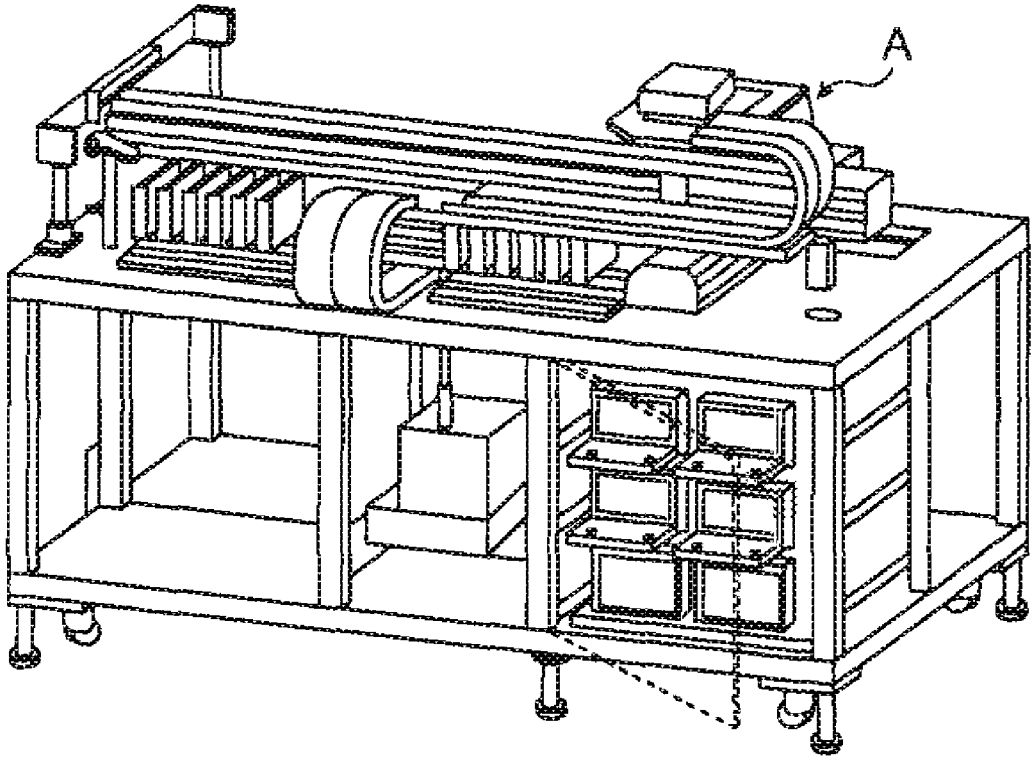
FIG. 2 is a diagram that shows the structure of a droplet discharging device according to one embodiment of the invention.

The droplet discharging head 10 is installed in a head unit portion (represented by A) of a droplet discharging device shown, for example, in FIG. 2. Droplet discharging devices include film forming devices employed for industrial use, in addition to image forming devices. A film forming device refers to a device that forms a functional film such as a color filter or a metal wiring through discharging of a liquid material that includes an organic substance such as a high-polymer material or an inorganic substance such as metallic particles, onto a substrate.

Having been taken into the droplet discharging head 10 from an external supply unit via ink inlets 17, a liquid material fills the space that forms the reservoirs 18, the cavities 103 and the nozzle portions 100. Subsequently, electric signals transmitted from the electrodes 19 to the piezoelectric elements 14 generate a flexure in the piezoelectric elements 14 and the diaphragm 13, increasing the pressure inside the cavities 103 for a moment, thereby causing droplets to be discharged from the nozzle portions 100.

Figure 3A:
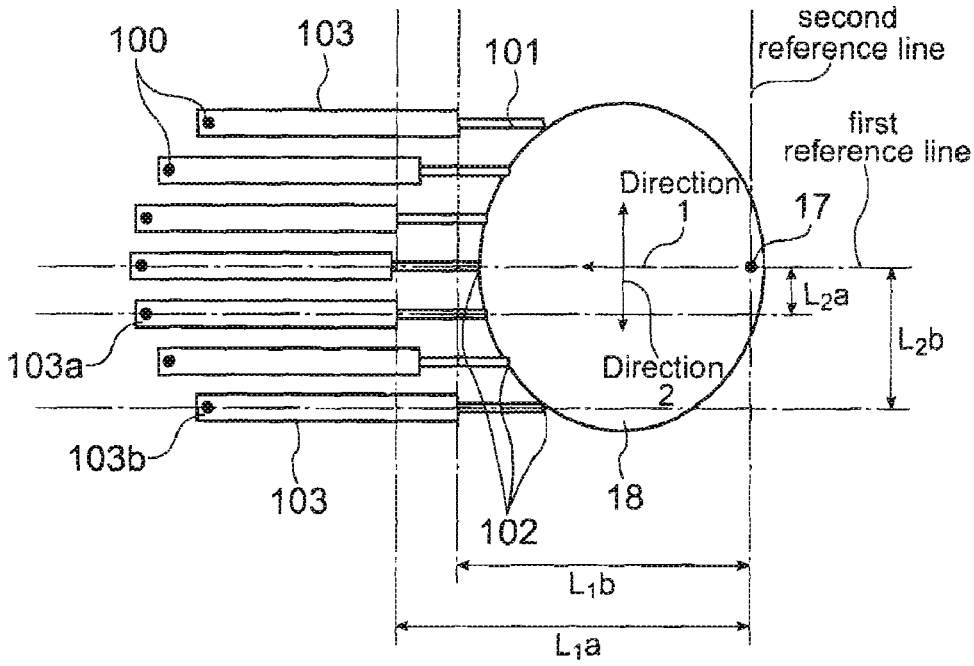
FIGS. 3A and 3B are diagrams that show a reservoir, cavities and nozzle portions of a droplet discharging head according to a first embodiment of the invention as observed from above.
Figure 3B:
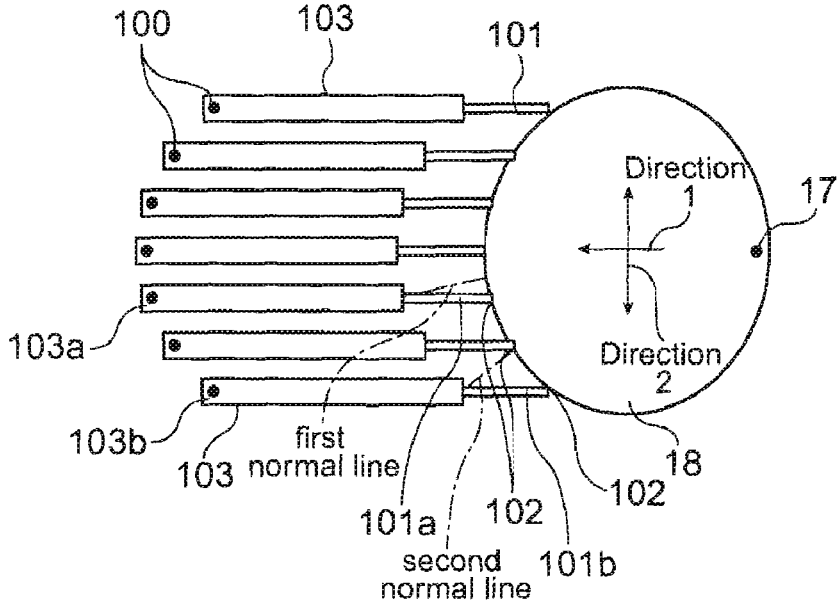

In FIGS. 3A and 3B, a plurality of cavities 103 are connected to one reservoir 18 through a plurality of ink supply passages 101. The droplet discharging head 10 includes at least one such reservoir 18 thus connected with a plurality of cavities 103.

The material inlet 17 is located on a circumferential edge part on the farther side of the reservoir 18 from the cavities 103. This is for facilitating escape of bubbles in the reservoir 18.

In the first embodiment, the reservoir 18 has an oval shape and the cavities 103 are each connected to the reservoir along an arc of the oval.

As shown in FIG. 3A, the longer the interval between a cavity 103 and the material inlet 17 is in Direction 1 (a first direction), the shorter the interval therebetween is in Direction 2 (a second direction). In other words, the endmost cavities 103 are both located with a longer interval from the material inlet 17 in Direction 2, but with a shorter interval therefrom in Direction 1, as compared to the cavity 103 in the center.

Namely, assuming that a straight line passing through the material inlet 17 in the first direction is a first reference line and a straight line passing through the material inlet 17 in the second direction is a second reference line, the following relationship is established for a first cavity 103*a* and a second cavity 103*b* of the plurality of cavities 103. In the case where a first distance in the first direction ($L_1$a), which is the distance between the second reference line and the first cavity 103*a*, is larger than a second distance in the first direction ($L_1$b), which is the distance between the second reference line and the second cavity 103*b*, a first distance in the second direction ($L_2$a), which is the distance between the first reference line and the first cavity 103*a*, is smaller than a second distance in the second direction ($L_2$b), which is the distance between the first reference line and the second cavity 103*b*.

Furthermore, the positional relationship between the plurality of cavities 103 may also be described as follows.

Namely, in FIG. 3B, a first normal line made from the outer circumference of the reservoir 18 to the connection between the first cavity 103*a* and a first ink supply passage 101*a* is shorter in length than the first ink supply passage 101*a*. Also, a second normal line made from the outer circumference of the reservoir 18 to the connection between the second cavity 103*b* and a second ink supply passage 101*b* is shorter in length than the first normal line. That means, even if the first ink supply passage 101*a* and the second ink supply passage 101*b* are equal in length, the first normal line and the second normal line are different in length.

A normal line here refers to a straight line perpendicular to a line that is tangent to the outer circumference of the reservoir 18.

Provided here that the first ink supply passage 101*a* and the first normal line are equal in length and the second ink supply passage 101*b* and the second normal line are equal in length, the difference between the lengths of the ink supply passages surface in the form of a difference between their capabilities to supply the liquid material to the respective cavities. A problem of this kind, as well, can be resolved by the features of the droplet discharging head shown in FIG. 3B.

Figure 4:
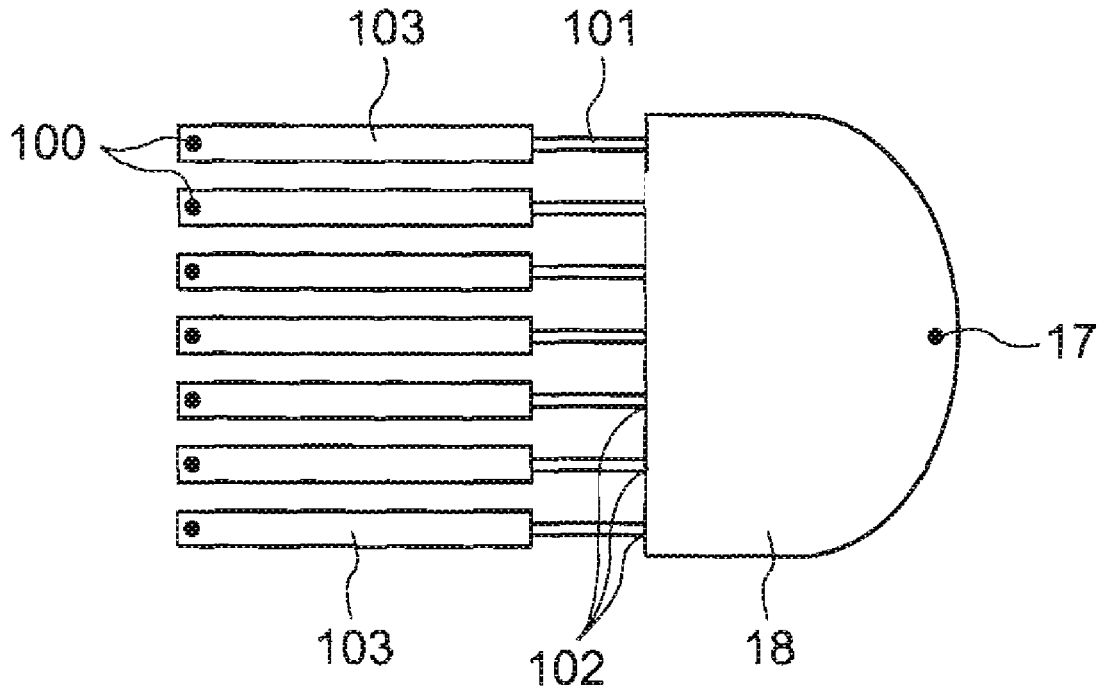
FIG. 4 is a diagram that shows a reservoir, cavities and nozzle portions of a droplet discharging head according to a comparative example as observed from above.

In contrast, in a comparative example shown in FIG. 4, the reservoir 18 has a semicircular shape and all the cavities 103 are connected to the side of the chord in its shape.

Therefore, the cavities 103 are located with an equal interval from the material inlet 17 in Direction 1 (the first direction), irrespective of their interval from the material inlet 17 in Direction 2 (the second direction) perpendicular to Direction 1 that runs from the material inlet 17 toward the cavities 103. Namely, the endmost cavities 103 are both located with a longer interval from the material inlet 17 in Direction 2 as compared to the central cavity 103, but with respect to Direction 1 all the cavities 103 are located at an equal interval from the material inlet 17.

Figure 5A:
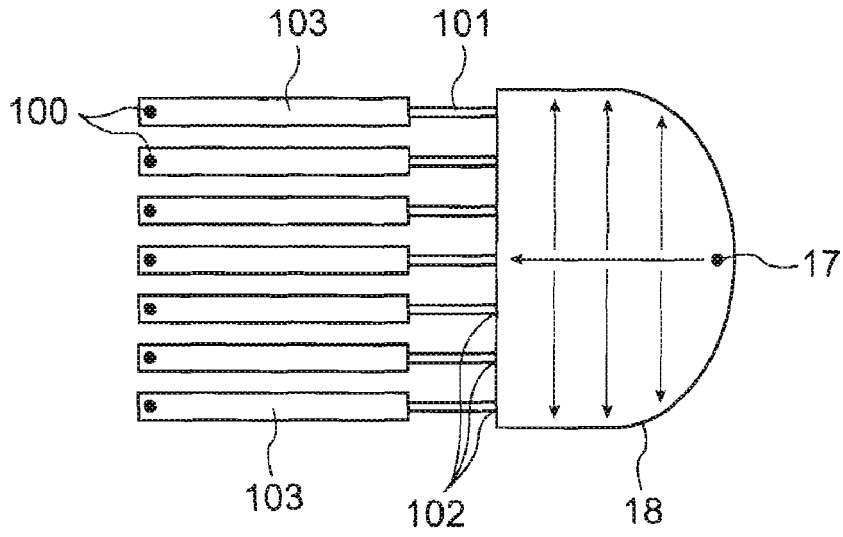
FIG. 5A is a diagram that shows the flows of ink in the reservoir of the droplet discharging head according to the comparative example.

Supply of ink into the reservoir 18 via the material inlet 17 generates a straight flow of ink, flowing from the material inlet 17 toward the chord to which the cavities 103 are connected, as well as flows of ink branching from the straight flow. FIG. 5A indicates the major flows of ink in the reservoir of the droplet discharging head according to the comparative example, and FIG. 5B indicates the major flows of ink in the reservoir 18 of the droplet discharging head 10 according to the first embodiment, respectively by arrows.

As shown in FIG. 5A, in the comparative example, the nearer a cavity 103 is to the respective ends of the group of cavities, i.e. the longer the interval in Direction 2 from the material inlet 17 is for the cavity 103, the longer it takes for the ink to reach the cavity 103 and, thus, the worse the supply efficiency is for the cavity 103. Consequently, cavities 103 near the respective ends of the group of cavities may not be fed with sufficient ink at times.

Figure 5B:
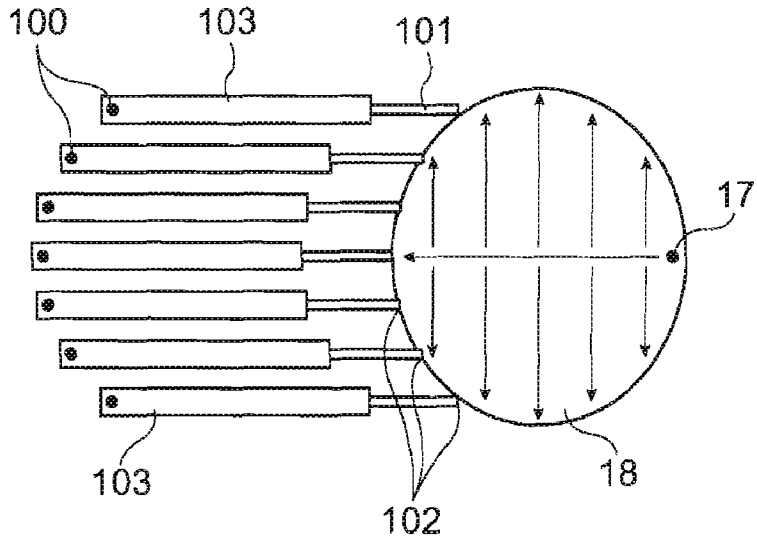
FIG. 5B is a diagram that shows the flows of ink in the reservoir of the droplet discharging head according to the first embodiment of the invention.

In the droplet discharging head 10 according to the embodiment of the invention, as shown in FIG. 5B, the longer the interval in Direction 2 from the material inlet 17 is for a cavity 103, the shorter the interval in Direction 1 from the material inlet 17 is for the cavity 103. Thus, the difference in time it takes for the ink to reach each of the cavities 103 is reduced and the supply efficiency is maintained nearly uniform.

The reservoir 18 according to the first embodiment can be formed by electroforming using a metal such as nickel, cobalt or manganese or an alloy of those metals. Alternatively, it may be integrally formed together with the cavity 103 by implementing photolithography onto a silicon substrate.

Figure 6A:
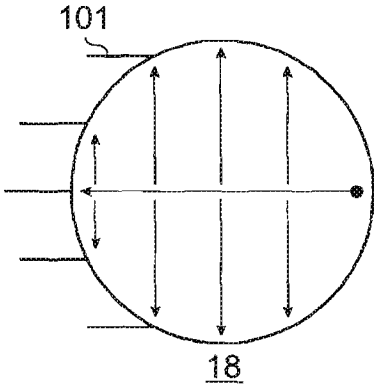
FIGS. 6A through 6E are diagrams that show modifications of the reservoir of the droplet discharging head according to the first embodiment of the invention.
Figure 6B:
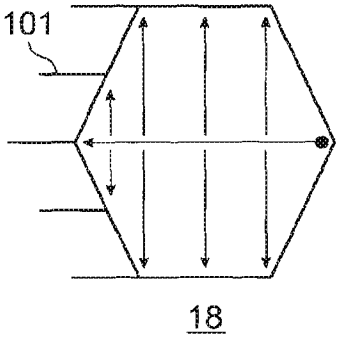
Figure 6C:
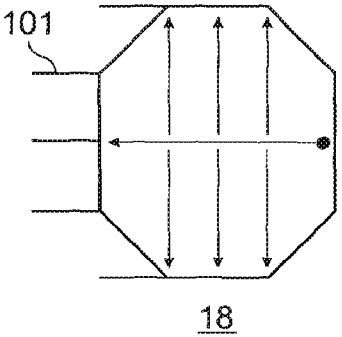
Figure 6D:
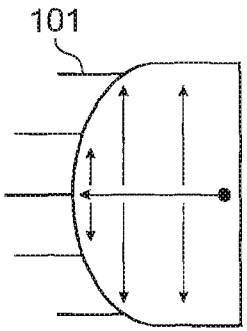
Figure 6E:
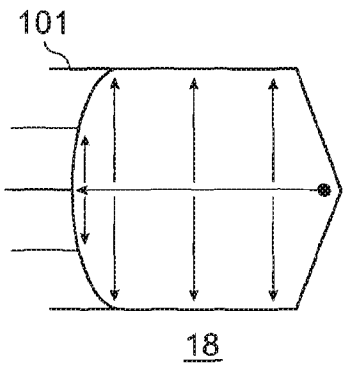

As shown in FIGS. 6A through 6E, the reservoir 18 may be of any shape if it allows the ink to reach each of the cavities 103 with little time difference. For example, the shape may be circular as shown in FIG. 6A or polygonal as shown in FIGS. 6B and 6C. Or, it may be curved on the side to which the cavities are connected, as shown in FIGS. 6D and 6E.

As described above, in the droplet discharging head 10 according to the first embodiment, the longer the interval from the material inlet 17 is for a cavity 103 in Direction 2 perpendicular to Direction 1, the shorter the interval from the material inlet 17 is for the cavity in Direction 1.

Consequently, the difference in time for the ink to reach each of the cavities 103 is reduced and the efficiency in supply of ink is kept nearly uniform for each of the cavities 103. This reduces variation in the supply of material to each nozzle.

In particular, in order to make discharged droplets more minute, it is necessary to reduce the size of the entire flow path of ink, including the reservoir 18. However, reduction in the size of the reservoir 18 increases resistance against the flow of ink in the reservoir 18, thereby deteriorating the efficiency in supply of ink to the cavities 103. In the meantime, application of the droplet discharging head 10 according to the first embodiment improves the efficiency in supply of ink to each nozzle.

Second Embodiment

Figure 7A:
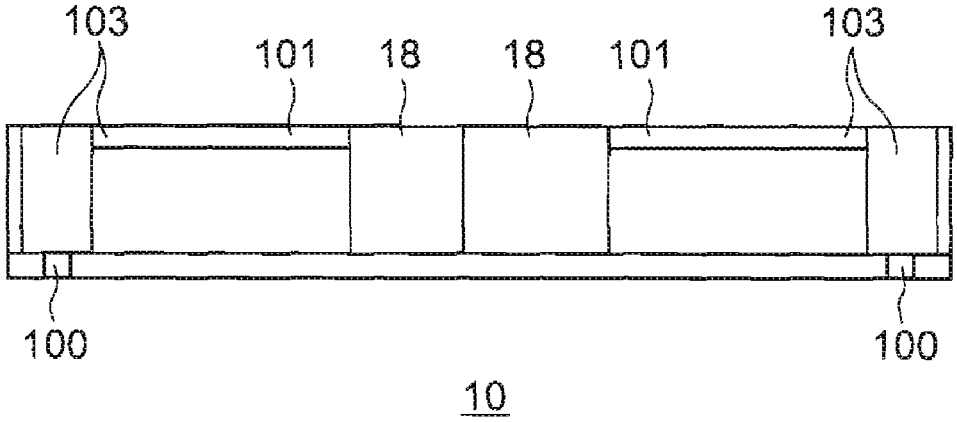
FIG. 7A is a sectional view of a droplet discharging head according to a second embodiment of the invention.
Figure 7B:
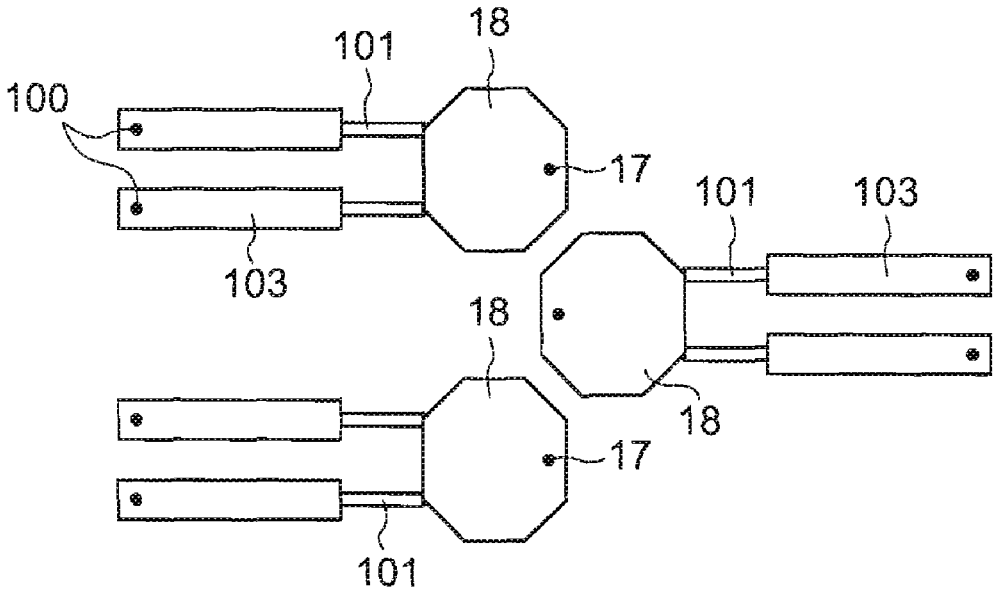
FIG. 7B is a diagram showing reservoirs, cavities and nozzle portions of the droplet discharging head according to the second embodiment of the invention as observed from above.

In a second embodiment, as shown in FIGS. 7A and 7B, a plurality of reservoirs 18 are disposed to form a zigzag shape. Since the reservoirs 18 are disposed in such a manner that they back against each other's material inlets 17, the cavities 103 are disposed on both the right and the left sides of the reservoirs 18.

In the second embodiment, as in the first embodiment, the longer the interval from the material inlet 17 is for a cavity 103 in Direction 2 perpendicular to Direction 1 that runs from the material inlet 17 toward the cavities 103, the shorter the interval from the material inlet 17 is for the cavity 103 in Direction 1.

In the same way as in the first embodiment, the droplet discharging head 10 according to the second embodiment of the invention allows the efficiency in supply of ink to each of the cavities 103 to be kept nearly uniform, thereby reducing variation in the supply of a material to each nozzle. In addition, the reservoirs 18 can be disposed with a high density since they are disposed to form a zigzag shape in backing against each other's material inlets 17.

The entire disclosure of Japanese Patent Application Nos: 2006-064777, filed Mar. 9, 2006 is expressly incorporated by reference herein.

What is claimed is:

1. A droplet discharging head comprising:

a nozzle portion that discharges a liquid material;

a plurality of liquid chambers, each of a liquid chamber being connected with the nozzle portion and supplies the liquid material to the nozzle portion by receiving a pressure from outside; and a reservoir that is connected with the plurality of the liquid chambers through a plurality of ink supply passages and supplies the liquid material fed from outside via a material inlet to the plurality of liquid chambers, wherein a direction from the material inlet toward the liquid chamber is a first direction, a direction perpendicular to the first direction is a second direction;

a straight line passing through the material inlet in the first direction is a first reference line, a straight line passing through the material inlet in the second direction is a second reference line, a first distance is longer than a second distance, a third distance is shorter than a fourth distance, the first distance is a distance of a first liquid chamber among the plurality of liquid chambers and the second reference line, the second distance of a second liquid chamber among the plurality of the liquid chambers and the second reference line, the third distance is a distance of the first liquid chamber and the first reference line, the fourth distance is a distance of the second liquid chamber and the first reference line.

2. A droplet discharging head comprising:

a reservoir having a material inlet;

a plurality of ink supply passages connected to the reservoir;

a plurality of liquid chambers, one of the plurality of liquid chambers being connected to one of the plurality of ink supply passages; and a plurality of nozzle portions, one of the plurality of nozzle portions being connected to one of the plurality of liquid chambers, a length of a normal line from an outer circumference of the reservoir to a connection between a first liquid chamber among the plurality of liquid chambers and a first ink supply passage among the plurality of ink supply passages being shorter than a length of the first ink supply passage.

3. A droplet discharging head comprising:

a reservoir having a material inlet;

a plurality of ink supply passages connected to the reservoir;

a plurality of liquid chambers, one of the plurality of liquid chambers being connected to one of the plurality of ink supply passages; and a plurality of nozzle portions one of the plurality of nozzle portions being connected to one of the plurality of liquid chambers, a length of a first normal line from an outer circumference of the reservoir to a connection between a first liquid chamber among the plurality of liquid chambers and a first ink supply passage among the plurality of ink supply passages being different from a length of a second normal line from the outer circumference of the reservoir to a connection between a second liquid chamber among the plurality of liquid chambers and a second ink passage among the plurality of ink supply passages.

4. The droplet discharging head according to claim 3, a length of the first normal line being shorter than a length of the first ink supply passage, the first normal line being from the outer circumference of the reservoir to the connection between the first liquid chamber among the plurality of liquid chambers and the first ink supply passage among the plurality of ink supply passages.

5. The droplet discharging head according to claim 3, the plurality of ink supply passages being each different in length.

6. The droplet discharging head according to claim 3, the reservoir having a plurality of connections connecting to the plurality of supply passages, the reservoir having a side surface that is at least partly a curved face, and the plurality of connections being formed on the curved face.

7. The droplet discharging head according to claim 3, the reservoir having a plurality of connections connecting to the plurality of supply passages, the reservoir having a polygonal bottom face, the reservoir having a side surface that is composed of a plurality of faces, and a first of the plurality of connections being formed on one of the plurality of faces while a second of the plurality of connections is formed on another of the plurality of faces.

8. The droplet discharging head according to claim 3 comprising a plurality of the reservoirs.

9. The droplet discharging head according to claim 8, the plurality of reservoirs being disposed to form a zigzag shape.

10. A droplet discharging device comprising the droplet discharging head according to claim 3.

* * * * *